US005223098A

United States Patent [19]

Cluyse et al.

[11] Patent Number: 5,223,098

[45] Date of Patent: Jun. 29, 1993

[54] CLAY COMPOSITIONS AND THEIR USE IN PAPER MAKING

[75] Inventors: Jean Cluyse, Louvain-La-Neuve, Belgium; Philip Ford, Suffolk, Va.; John G. Langley, Leeds, England; Peter Lowry, Suffolk, Va.

[73] Assignee: Allied Colloids Limited, England

[21] Appl. No.: 788,220

[22] Filed: Nov. 5, 1991

[30] Foreign Application Priority Data

Nov. 5, 1990 [GB] United Kingdom ..... 9024016

[51] Int. Cl.[5] ..... D21H 17/69

[52] U.S. Cl. ..... 162/181.2; 162/181.3; 162/181.8; 162/183

[58] Field of Search ..... 162/181.8, 183, 181.2, 162/181.1, 181.3

[56] References Cited

U.S. PATENT DOCUMENTS 4,753,710 6/1988 Langley et al. ..... 162/181.8
5,015,334 5/1991 Derrick ..... 162/181.8

FOREIGN PATENT DOCUMENTS 0017353 1/1980 European Pat. Off. .
64-61588 5/1988 Japan .
64-45754 3/1989 Japan .
084630 12/1987 U.S.S.R. .

OTHER PUBLICATIONS

"Production and Control of Properties of Highly-Concentrated Clay Suspensions" by B. I. Sych, Journal of the Khar'kov Polytechnic Institute, 1968 27 (74), 23-28.

*Primary Examiner*—Peter Chin
*Attorney, Agent, or Firm*—Ostrolenk, Faber, Gerb & Soffen

[57] ABSTRACT

Bentonite swelling clay is provided to a paper making mill as a fluid concentrate containing more than 15% bentonite wherein swelling of the bentonite is prevented by inorganic electrolyte in the concentrate, and the bentonite swells upon dilution either before addition of the cellulosic suspension or after addition.

8 Claims, No Drawings

CLAY COMPOSITIONS AND THEIR USE IN PAPER MAKING

This invention relates primarily to paper making processes and in particular to the provision of bentonite swelling clays in a form that is particularly convenient for use at the paper mill. The invention also relates to the provision of such dispersions for other purposes.

Many processes are known in which paper is made by providing a cellulosic suspension at a paper mill, mixing a bentonite swelling clay into the cellulosic suspension while the clay is in the form of an aqueous dispersion and draining the cellulosic suspension.

It is not possible effectively to add the powder direct to the aqueous cellulosic suspension, since such addition would not be sufficiently uniform throughout the suspension. Instead, the powder has to be converted to a relatively dilute aqueous dispersion, and this slurry is then added to the aqueous suspension. The aqueous dispersion has to be relatively dilute (usually below 10% and often below 5% dry weight bentonite based on the total weight of the dispersion) because the bentonite in the dispersion is swollen and if the dispersion is more concentrated then its properties render the dispersion inconvenient to handle and mix. Thus the dispersion will have very high viscosity and will usually be thixotropic and so may lead to gel formation.

The bentonite is generally supplied as a powder of small particle size, and this can give problems due to poor flow properties and the risk of dusting. Alternatively the bentonite can be supplied as aggregates or granules.

The bentonite is usually supplied in combination with an activator that will promote swelling upon contact with water. The activator is generally a source of sodium that can exchange with calcium in the bentonite. For instance the dry bentonite may be supplied as a blend with from 3 to 10% by weight sodium carbonate.

It is also known to extend bentonite by the addition of small amounts, generally below 1%, of anionic or nonionic polymers.

The initial aqueous dispersion of the bentonite that is formed has to be relatively dilute, typically below 10% and often below 5% bentonite dry weight based on the total weight of dispersion, because otherwise the dispersion will have properties that render it inconvenient to handle and mix. This is because the bentonite swells rapidly in the dispersion and not only tends to impart high viscosity but will also impart thixotropic rheological characteristics. Thus, on removal of shear, viscosity will increase with time and if the dispersion is insufficiently dilute it will lead to the formation of a gel with the result that the dispersion is no longer fluid and cannot satisfactorily be handled by conventional pumps.

The formation of the dilute fluid dispersion of swollen bentonite from dry bentonite necessitates mixing the dry bentonite with water vigorously and for a prolonged period, for instance by tumble mixing for two hours. As the dispersion has to be dilute and the mixing takes a long time, this necessitates the provision of very large capital investment in mixing apparatus.

Additionally, the user has to be equipped to handle the initial solids, and if conventional fine powdered bentonite is used then this necessitates apparatus that will avoid flow and dusting difficulties. Also the user must, of course, have apparatus for handling and using the dilute aqueous fluid dispersion.

It would be desirable to be able to provide the bentonite in the form of a concentrated fluid dispersion that could easily be diluted to a suitably dilute concentration at the paper mill merely by simple mixing with water. Thus it would be desirable to be able to eliminate the need for prolonged and vigorous mixing of dilute dispersions and it would, in most instances, be desirable to supply the user with a fluid, so as to eliminate the need for the user to have both solids handling and liquids handling apparatus.

In JP-A-6461588 (Sho 62-216354) it is proposed to add bentonite to an aqueous suspension simultaneously with an anionic high molecular weight compound. In the examples, the relevant anionic compounds have intrinsic viscosity ranging from 2.1 to 10, and this would indicate molecular weights well in excess of 1 million. In the example, the bentonite and anionic high molecular weight compound are brought into a form suitable for addition to the aqueous cellulosic suspension by dispersing into 99 parts by weight water a mixture of 0.9 parts by weight bentonite and 0.1 parts by weight of the anionic high molecular weight compound. Accordingly this is merely another disclosure of a process in which the mill disperses bentonite powder into water, and differs from conventional techniques merely by including some high molecular weight anionic polymer with the bentonite, and it makes no contribution to solving the problem set out above.

When bentonite has swollen in water the initially fine particles of bentonite (that previously gave a large particle area) will have become disrupted such that there is an enormous increase in the surface area of the bentonite, and it can be considered therefore that the small particles have been disrupted by the swelling into a very large number of even smaller particles. It is the resultant enormous surface area of the bentonite that contributes to its success in many paper-making processes. A disadvantage of adding the bentonite in combination with a high molecular weight anionic polymer, as in JP-A-6461588 is that the high molecular weight polymer will have a tendency to flocculate the bentonite and so although some swelling may occur there will be a tendency for the very fine swollen particles to aggregate, with the result that the effective surface area of the swollen bentonite will be greatly reduced. This clearly is highly undesirable for those instances where, as is often the case, the highest possible surface area is required.

It is known (e.g., U.S. Pat. No. 3,705,838) to mix bentonite with an inorganic metal salt such as calcium carbonate and a fatty acid so as to inhibit swelling and wetting in a roofing waterproofing composition. It has also been proposed to add certain electrolytes to inhibit swelling of bentonite in drilling muds and to reduce the viscosity of clay suspensions so as to permit their pipeline transport.

The use of electrolytes to inhibit the swelling of clays is also described by Sych in Journal of the Kharrkov Polytechnic Institute 1968, 26 (74), 23 to 28.

Also, it is standard practice to include some electrolyte with dry bentonite as activator to promote the dispersion of the dry bentonite into water, for instance as described in JP-A-6445754.

There have also been some suggestions to use bentonite dispersions containing polymeric polyelectrolyte in paper manufacture. For instance in U.S. Pat. Nos. 4,613,542 and 4,624,982 the fluidity of a dispersion of clay in water is promoted by including a small amount (for instance 0.25% based on bentonite) of low molecular weight sodium polyacrylate or other acrylic polymer, and in the Examples the product is subsequently dried and heated to restore the swellability of the bentonite. Also, Derrick in, for instance, EP 373306 and U.S. Pat. No. 5015334 describes paper making processes in which the bentonite is supplied in association with anionic organic polymer. He states that the dispersion should have a clay concentration of at least 5% up to a maximum concentration at which it is pumpable and which is preferably above 10% and up to for example 25% (column 4 lines 14 to 18 U.S. Pat. No. 5015334). However, there is no clear disclosure as to the clay concentrations that can actually be obtained.

Despite the long standing knowledge that it is possible to reduce the viscosity of a bentonite dispersion by including certain dissolved materials in the dispersion the traditional practice has been to supply the mill with powdered bentonite and for the mill then to make a dilute dispersion by mixing this powdered bentonite with water. As mentioned above, this is difficult to perform satisfactorily. The disclosure in, for instance, U.S. Pat. No. 5015334 does not provide any significant teaching of the possibility of a change in this.

A process according to the invention for making paper comprises providing a cellulosic suspension at a paper mill, mixing a bentonite swelling clay into the cellulosic suspension while the clay is in the form of an aqueous dispersion and draining the cellulosic suspension, characterised in that the bentonite swelling clay is provided at the paper mill as a fluid concentrated dispersion and the clay is mixed into the cellulosic suspension either in the form of this concentrated dispersion or in the form of a diluted dispersion obtained by diluting the concentrated dispersion, and wherein the concentrated dispersion comprises at least 15% (dry weight) of the bentonite swelling clay dispersed in substantially unswollen form in an aqueous medium containing sufficient dissolved monomeric electrolyte to prevent substantial swelling of the bentonite swelling clay.

The bentonite swelling clay is often supplied as a mixture with an activator (as discussed below) and containing water that has been absorbed from the atmosphere. For instance a typical commercial material sold as a bentonite type clay might consist of about 5% activator, 10 to 15% measurable absorbed water and the balance (to 100%) actual mineral. In the specification, the percentages and concentrations are calculated on the basis of the actual mineral (i.e. excluding activator and measurable absorbed water).

The cellulosic suspension is provided at the paper mill either by pulping dried pulp or, in an integrated mill, by conventional pulping techniques.

The bentonite swelling clay is provided at the mill as a fluid concentrated dispersion either by delivering the concentrate to the mill or by making the concentrate at the mill by blending dry bentonite, electrolyte and water as described below.

The bentonite can be mixed with the cellulosic suspension either at the thick stock stage (i.e. before dilution of the suspension to the final concentration at which it is drained) or at the thin stock stage. The bentonite can be added as the concentrate or as a dispersion obtained by dilution of this concentrate. It is necessary to ensure that the bentonite is uniformly distributed throughout the cellulosic suspension and it is usually easier to achieve this by adding it as a diluted dispersion. However if care is taken to ensure adequate mixing, it can be added as a concentrate.

When it is added as a diluted dispersion, it can be added in a form where the concentration of electrolyte is still sufficiently high that the bentonite is in substantially unswollen form, but preferably the concentrated dispersion is diluted with water to form a diluted aqueous dispersion containing below 10% (dry weight) bentonite swelling clay in which the clay is in swollen form before addition to the cellulosic suspension.

An important feature of the invention is that it is possible to provide the bentonite swelling clay in a dispersion having a very high solids content containing sufficient inorganic electrolyte substantially to prevent swelling, and then to allow the bentonite to swell (either before addition to the cellulosic suspension or after addition) as a result of dilution of the electrolyte concentration.

The anionic polymers that had been proposed in, for instance, U.S. Pat. No. 5015334 are much less effective at permitting the provision of a concentrated, fluid, non swollen, dispersion of bentonite swelling clay and so do not allow the high clay contents that are obtainable in the invention. In particular, in the invention, it is easy in practice to obtain a fluid concentrated suspension containing at least 15% bentonite swelling clay at relatively low amounts of added electrolyte for instance not more than 7% and often not more than 5% electrolyte by weight of electrolyte based on the volume of fluid dispersion. If polymeric electrolytes are used, it is necessary either to increase the amount of polymer (and this can be unnecessarily expensive and may have other undesirable effects) or to reduce the amount of bentonite.

The fluid concentrate of substantially unswollen bentonite can be made by blending bentonite in any convenient physical form, usually a powder or granulate, with the aqueous electrolyte solution. Often powdered bentonite, powdered electrolyte and water are blended, and frequently the bentonite and electrolyte are supplied as a premix. The bentonite (and the electrolyte if present as a solid) may be supplied as powder but it is particularly preferred to supply them in the form of aggregates or granules that will disintegrate upon addition to water. The bentonite can be free of additives such as activators and extenders but the bentonite is conveniently a commercial source of bentonite in which event it may already contain some activator such as sodium carbonate or other electrolyte. However the amount of electrolyte that is customarily added as an activator is insufficient to prevent swelling of the bentonite in the fluid concentrates, and so additional electrolyte must be included.

The fluid concentrate can be made by stirring the dry bentonite with the water and added electrolyte (and optionally dispersant and/or stabiliser) with sufficient agitation and for sufficient duration to achieve a homogeneous stable dispersion. Because the bentonite does not swell substantially, this mixing can be achieved much more easily than when bentonite is being converted, in a single stage, from a dry form to a dilute swollen dispersion. Also, the volume of the mixing apparatus required for this stage is much less than the volume that is required for converting dry bentonite into a swollen dilute dispersion. For instance the concentrate can be made merely by stirring the ingredients for 1 to 10 minutes using any conventional mixer provided with moderately vigorous agitating means, such as a tumble mixer or a mixer fitted with a stirrer. Typically the concentrate can be made by stirring the concentrate at 500rpm for 5 minutes.

Alternatively the bentonite and electrolyte can be mixed dry in the appropriate quantities and added to fresh water to give the required high solids concentrate by, for instance, mixing at 500rpm for 5 minutes.

The bentonite and electrolyte may be agglomerated or granulated to ensure thorough mixing of the dry components and facilitate handling. The dry mixed, agglomerated or granulated product may be added to fresh water in the appropriate quantities to obtain the high solids fluid slurry according to the invention.

This may be carried out at any convenient location including the end user's premises where the benefit to the user would be the reduced size and cost of make-up equipment required to prepare aqueous slurries.

The fluidity of the concentrate will decrease as the amount of bentonite increases and generally the composition will contain as much bentonite as possible, consistent with the fluidity that is required for the handling apparatus that is to be used for making and using the composition. Preferably the fluid composition has a viscosity of below 50 poise measured at 20° C. using a Brookfield RVT viscometer, spindle 4 at 20rpm and the 10 minute gel strength is preferably below 10 lb/100 sq.ft as measured using a Fann viscometer at 3 rpm.

Because the bentonite is much less swollen than it will be when the concentrate is mixed with water, the amount of bentonite in the concentrate can be very much greater (for equivalent fluidity) than if the bentonite was being dispersed in water without the addition of electrolyte that is required in the invention. Usually the amount of bentonite is above about 15% and often it is above 20% and in some instances it can be above 30 or even 35%, by weight of the total composition. This compares to compositions that are substantially free of the electrolyte or that only contain activating amounts of electrolyte and that cannot normally contain more than about 10% bentonite, and frequently only contain about 5% bentonite or even less, while retaining suitable fluidity and other rheological properties.

Any monomeric electrolyte (or mixture of electrolytes) that, in the concentration that is present, will cause sufficient inhibition of the swelling of the bentonite can be used provided it will allow the bentonite to swell sufficiently for its intended purpose when the fluid concentrate is diluted with water. The total electrolyte can consist solely of material that is added to bentonite that is substantially free of activator or other electrolyte, but often the total electrolyte consists of activator electrolyte (such as sodium carbonate) and added electrolyte.

Added electrolytes containing divalent or higher valency cations (for instance calcium) can be used in some instances but these divalent ions tend to exchange with the sodium ions that are present in the bentonite initially and this can inhibit the subsequent swelling of the bentonite. It is generally preferred therefore that the cations of the electrolyte should be monovalent, and in particular ammonium or alkali metal, generally sodium.

The added electrolyte must consist of or comprise monomeric electrolyte, i.e it is not polymeric. Preferably the added electrolyte is wholly inorganic. It is sometimes desirable to include also a polymeric organic electrolyte, such as any alkali metal or ammonium (generally sodium) salt of low molecular weight polymer that is homopolymer of ethylenically unsaturated carboxylic or sulphonic acids or copolymer of either or both of these with a non-ionic monomer such as acrylamide. A preferred organic polymeric electrolyte is sodium polyacrylate but other polyacrylic acid salts can be used. The molecular weight preferably is relatively low as otherwise the polymer may have a tendency to cause flocculation or coagulation, and this can significantly reduce the available surface area and performance characteristics of the bentonite after swelling in water. Generally the molecular weight should be below around 20,000, and often is below 10,000, for instance 1,000 to 5,000. This organic electrolyte is generally included primarily as a scale preventor and/or as a dispersant and so is usually present in low quantities, e.g. up to 2 or 3% based on the fluid.

Inorganic polymers, such as polyphosphates, could be used.

Preferably, however, the added electrolyte is a simple sodium or ammonium or other monovalent salt, for instance a chloride, sulphate or carbonate or other anion of a nonpolymeric acid, preferably an inorganic acid.

Although the presence of the electrolyte inhibits or prevents swelling of the bentonite and thus prevents the composition losing fluidity due to gelling, at the high solids contents that can now be provided there may be a tendency for part at least of the concentrate to lose fluidity as a result of settlement of the solids in the concentrate. This tendency can be inhibited by adding a concentrate. This tendency can be inhibited by adding a stabilising polymer. This stabilising polymer can itself by an electrolyte but this is generally unnecessary and, in particular, it is desirable to select a stabilising polymer that does not cause significant flocculation or coagulation. Suitable polymers include water-swellable or water-soluble polymers that can be cellulosic derivatives, e.g. methyl cellulose, hydroxyethyl cellulose and carboxymethyl cellulose, sodium alginate or starch or other natural polymers, or acrylic or other synthetic polymers. Preferred polymers include associative polymers such as are described in EP 216479 (for instance in Example 1 of that) or in prior art discussed in EP 216479. The associative polymer may be cross linked. Stabilising polymers are typically included in amounts of from 1 to 50, often around 5 to 20, grams per litre of concentrate.

The total amount of the chosen electrolyte or electrolytes must be such as to prevent the bentonite hydrating and swelling in the aqueous electrolyte to such an extent that the concentrate remains fluid even after standing for a prolonged period. The amount is generally from 20 to 200 grams electrolyte dry weight per litre of fluid. When the total amount of electrolyte consists solely of simple inorganic salts the amount is generally in the range 20 to 150 g/l, most preferably around 25 to 100 g/l (2.5 to 10%), often around 50 g/l to 75 g/l.

Since it is generally preferred to use bentonite that already includes activator inorganic electrolyte, preferred fluid compositions are formed using 5 to 30 g/l (0.15 to 3%), often around 10 to 20 g/l activator electrolyte and 10 to 100 g/l (1 to 10%) often around 30 to 60 g/l added electrolyte.

The total amount of electrolyte that is present in the concentrate, based on the dry weight of bentonite, is generally from 8 to 50%, preferably 12 to 30%, often 15 to 25%, based on the dry weight of bentonite. Generally the weight of added electrolyte is from 0.5 to 5, often 1 to 3, times the weight of any activator electrolyte that may be present initially.

As mentioned, it is possible to include also polymeric electrolyte, for instance low molecular weight sodium polyacrylate. Generally materials such as this are added merely as dispersants or scale inhibitors in which event the amount will generally be low, for instance 0.1 to 2%, often around 0.2 to 1% (weight by volume). However, it is possible to use larger amounts for instance up to 15%, in which event the amount of inorganic electrolyte may be reduced. However it will still generally fall within the preferred range of 2.5 to 10%.

The water that is used to dilute the concentrate to form the dilute swollen dispersion can be fresh water or any aqueous medium (for instance cellulosic suspension) that will impart a sufficient dilution effect on the electrolyte to reduce the electrolyte concentration to a value at which it has little or no inhibiting effect on the swelling of bentonite, and generally the total electrolyte concentration of the final aqueous medium is below 10 g/l, preferably below 5 g/l and often below 1 g/l. The presence of hardness salts in the dilution water can inhibit the swelling of the bentonite and so if the dilution water contains hardness salts such as calcium salts the amount of these is preferably below 0.7 g/l, most preferably below 0.2 g/l. If the dilution water does contain significant amounts of hardness salts, their effect can be minimised by using, as the initial electrolyte, an alkali metal or ammonium salt of the same anion. In particular, it is preferred to use ammonium or sodium carbonate.

It is normally preferred to achieve substantially full swelling of the bentonite before adding the diluted composition to the main cellulosic suspension that is to be drained and so generally the fluid concentrate is diluted with at least 5, for instance 5 to 50, parts by volume dilution water to give a bentonite concentration that is generally not more than 5% or at the most 10%. Preferably however the rates of dilution are considerably greater, typically in the range 10 to 500, preferably 50 to 200, parts by volume dilution water per part by volume fluid concentrate since this can lead to bentonite concentrations in the diluted aqueous composition in the range 0.06 to 3%, preferably 0.15 to 0.8%, dry weight bentonite based on the weight of the dilute composition.

The amount of bentonite in the diluted dispersion will be sufficiently low that the dilute dispersion remains sufficiently fluid to be handled conveniently and so is below 10%, often below 5% and frequently below 3%.

Naturally, when the dilution is direct into the main cellulosic suspension, the final concentration will be very low.

The mixing of the concentrate with the dilution water can be effected very easily by any convenient mixing means. For instance it can be achieved merely by injecting the concentrate into a flowing stream of water, optionally followed by the application of deliberate turbulence to the stream so as to promote mixing. Naturally a suitable residence time may need to be provided, before use of the diluted dispersion, to allow full swelling of the bentonite.

The invention thus provides the great advantage that the diluted composition can be made using extremely simple mixing apparatus and the need for prolonged vigorous mixing in large mixing apparatus is eliminated. Further, the concentrate can be made using relatively simple and small mixing apparatus. Thus the user can either buy dry bentonite and mix it in two simple stages or, more usually, can buy a highly concentrated fluid concentrate and convert it to the desired dilute composition by a single very simple mixing stage.

As the bentonite swelling clays, one can use any of the anionic swelling clays that are conventionally referred to as bentonite-type clays or as bentonites. They are generally smectites. Suitable materials are sepialite, attapulgite and montmorillonite, the latter being preferred. Suitable smectite or montmorillonite clays include Wyoming bentonite and Fullers Earth and various clays include those known by the chemical terms of hectorite and bentonite. If desired, the clays can have been chemically modified, e.g., by alkali treatment to convert calcium bentonite to alkali metal bentonite. As indicated above, the bentonite is generally provided as a mixture of natural clay and 2 to 10% (dry weight of the bentonite) of an activator such as an alkali metal salt.

The paper making process of the invention can be any process for making paper (including board) that involves draining the cellulosic suspension produce a sheet material, which can then be dried in conventional manner.

It is known to include bentonite in paper making processes for various purposes and the invention is applicable to all of these. For instance the bentonite may be included as a pitch dispersant.

One paper-making process to which the invention can be applied is a process in which bentonite is added to a cellulosic suspension, typically in an amount of 0.02 to 2% dry weight and a medium or high molecular weight (e.g. above 500000) polymeric retention aid is added subsequently, generally after the last point of high shear (for instance in the head box immediately prior to drainage). The high molecular weight polymer can be non-ionic, anionic or cationic. The cellulosic suspension can be made from relatively pure pulp or from pulp having a relatively high cationic demand.

Processes of this type that are of particular value are those in which the pulp has a relatively high cationic demand and the polymer is substantially non-ionic and the paper product is preferably newsprint or fluting medium. Processes of this type in which the total filler content is relatively low are described in U.S. Pat. No. 4305781 to which reference should be made for further details of suitable polymers and suitable cellulosic suspensions and which is hereby incorporated by reference. These processes are of particular value when the cellulosic suspension contains de-inked waste.

The invention is of particular value when applied to processes in which a medium or high molecular weight cationic polymeric retention aid is added to the aqueous suspension, the suspension is subjected to shearing and the bentonite is then added after the shearing, and often after the last point of high shear, for instance at the head box prior to drainage.

The cationic polymer can be a natural material such as cationic starch but is preferably a substantially linear synthetic cationic polymer having molecular weight above 500,000. The amount of cationic polymer that is present in the dispersion at the time of shearing should be sufficient that flocs are formed by the addition of the polymer and the flocs are broken by the shearing to form microflocs that resist further degradation by the shearing but that carry sufficient charge to interact with the bentonite to give better retention than is obtainable when adding the polymer alone after the last point of high shear.

The shearing can be due merely to turbulent passage along a duct or can due to passage through a centriscreen, a pump or other shear-applying device.

Preferred processes include those commercialised by the applicants under the trade mark Hydrocol and preferred processes are described in, for instance, U.S. Pat. Nos. 4753710, 4913775 and 4969976 all of which are hereby incorporated by reference. The optimum amount of polymer for any particular process can be determined by routine experimentation, and will depend inter alia on whether low or medium molecular weight cationic polymer, and/or dry strength resin, had been incorporated in the aqueous suspension at some earlier stage.

The invention includes paper made by the described processes.

The invention also includes other industrial processes in which a dilute aqueous fluid dispersion of below 10% (dry weight) swollen bentonite is made by providing a concentrated aqueous fluid dispersion of above 15% (dry weight) substantially unswollen bentonite in an aqueous medium containing sufficient dissolved electrolyte to prevent substantial swelling of the bentonite, and forming the dilute dispersion by adding sufficient water to the concentrated dispersion to dilute the electrolyte to a concentration at which the bentonite undergoes substantial swelling.

The invention also includes a novel composition that is a concentrated aqueous fluid dispersion of above 15% dry weight substantially unswollen bentonite in an aqueous medium containing sufficient dissolved electrolyte to prevent substantial swelling of the bentonite. Certain compositions within this general definition are particularly preferred and are novel, especially compositions containing relatively large amounts of simple electrolytes such as sodium carbonate and sodium chloride, and compositions that contain both a simple inorganic electrolyte and also a polymeric material that can be a dispersant or a suspending agent.

In this processes, as in the paper making processes, the concentrated fluid dispersion may be mixed direct into the final aqueous medium in which it is to be used by generally it is converted into a dilute aqueous suspension of swollen bentonite before adding that diluted suspension to the aqueous medium in which it is to be used.

Such processes include Other processes according to the invention include viscosifying processes, such as processes in which the bentonite (either as a fluid concentrate containing sufficient electrolyte or as a dilute dispersion obtained by dilution of the concentrate) are added to an aqueous medium to modify its viscosity or other rheological properties. Such fluid media include downhole fluids such as drilling fluids. The following are some examples.

EXAMPLE 1

Various fluid concentrates in the form of mobile slurries of substantially unswollen bentonite are prepared by stirring bentonite containing 2 to 10% activator (generally 7% sodium carbonate) into a pre-formed aqueous solution of chosen added electrolyte. In each instance, the amount of bentonite that was added was the amount sufficient to render the composition stable even after prolonged standing and exhibited a viscosity below 100 poise @20° C. when measured using a Brookfield RVT viscometer, spindle 6 @20rpm and the 10 minute gel strength is below 10 lb/100 sq.ft as measured using a Fann viscometer at 3 rpm.

The selected bentonite, electrolyte, dosage of electrolyte and maximum amount of bentonite that could be included while the composition remained fluid, as defined above, are set out in the following table:

| Bentonite | Added Electrolyte | Added Electrolyte Dosage (wt/vol) | % Slurry Solids (wt/wt) |
|---|---|---|---|
| English Brown | $Na_2CO_3$ | 3% | 30% |
| " | NaCl | 3% | 27% |
| " | * Sodium polyacrylate | 1% | 18% |
| " | * Sodium polyacrylate | 5% | 24% |
| " | $Na_2SO_4$ | 3% | 22% |
| " | $(NH_4)_2SO_4$ | 3% | 34% |
| American White | $Na_2CO_3$ | 3% | 21% |
| " | NaCl | 3% | 27% |
| " | $Na_2SO_4$ | 3% | 19% |
| " | $(NH_4)_2SO_4$ | 3% | 23% |
| " | * Sodium polyacrylate | 1% | 9% |
| " | * Sodium polyacrylate | 5% | 14% |
| " | * Sodium polyacrylate | 10% | 25% |
| English Grey | NaCl | 3% | 27% |
| English White | NaCl | 3% | 27% |
| Imported White | NaCl | 3% | 27% |
| English Pale Brown | NaCl | 3% | 27% |
| New Zealand Brown | NaCl | 3% | 27% |
| Imported Pale Grey | NaCl | 3% | 27% |

* The data in this table demonstrates that the sodium polyacrylate compositions are inferior to those of the invention.

EXAMPLE 2

A laboratory process is conducted to simulate the performance that will be obtained in a commercial process broadly as described in U.S. Pat. No. 4753710. Thus a laboratory waste fibre furnish is prepared at 0.5%. An addition of 1 kg/tonne (dry on dry) of cationic polyacrylamide is made to 1000 mls of the stock. This is then sheared at 1500rpm for one minute. This is followed by an addition of 2kg/tonne (dry on dry) of bentonite. After the bentonite addition the drainage rate of the stock is evaluated using a modified Schopper Riegler apparatus.

In a process of the invention, a fluid concentrate is formed by blending 27% by weight bentonite (that contains 7% by weight, based on the bentonite, sodium carbonate) with an aqueous solution of 30 g/l sodium chloride. This concentrate is diluted in the ratio 270:1 to give a dilute aqueous swollen bentonite composition containing 0.1% bentonite and about 0.1 g/l sodium chloride.

A number of comparisons are conducted using no additives, using polymer alone, and using bentonite that was supplied as a powder and that was tumble mixed for two hours to make a 5% bentonite slurry which is then diluted down to 0.1% before addition to the cellulosic suspension. In each instance, the drainage time in seconds is recorded. The following results are obtained:

| Type of Bentonite | Supplied as | Drainage time (seconds) |
|---|---|---|
| English Brown | 27% in 30 g/l NaCl | 16 |

-continued

| Type of Bentonite | Supplied as | Drainage time (seconds) |
|---|---|---|
| American White | 27% in 30 g/l NaCl | 19 |
| English Brown | 5% in water | 14 |
| English White | 5% in water | 20 |
| (Polymer alone) | none | 59 |
| (no additives) | none | 119 |

From this it will be seen that the performance of the bentonite is substantially unchanged when provided as a fluid of the invention rather than as powder, but the process of the invention has the great advantage of easier handling of the bentonite.

EXAMPLE 3

The process of example 2 is repeated but using different electrolytes and different hardness waters for the dilution water. The following results are obtained:

| Bentonite | Electrolyte | Electrolyte dosage (wt/vol) | Water Hardness (ppm) | Drainage Time (seconds) |
|---|---|---|---|---|
| English Brown | NaCl | 3% | 0 | 16 |
| " | NaCl | 3% | 500 | 36 |
| " | $Na_2CO_3$ | 3% | 0 | 19 |
| " | $Na_2CO_3$ | 3% | 500 | 22 |

EXAMPLE 4

Various fluid compositions in the form of mobile slurries of substantially unswollen bentonite are prepared by stirring bentonite into a preformed aqueous solution of chosen electrolyte. The chosen electrolyte is a mixture of simple electrolyte to suppress hydration of the bentonite and polyelectrolytes to provide some viscosity to the aqueous phase and enhance physical stability, whilst maintaining the concentrated bentonite slurry fluid even after prolonged standing. In each instance, the amount of bentonite that was added was the amount sufficient to render the composition stable even after prolonged standing and exhibited a viscosity below 50 poise @20° C. when measured using a Brookfield RVT viscometer, spindle 4 @100 rpm and the 10 minute gel strength is below 10 lb/100 sq.ft as measured by Fann viscometer @3rpm.

The selected bentonite, electrolyte, polyelectrolyte, and dosage of electrolyte and polyelectrolyte and maximum amount of bentonite that could be included while the composition remained fluid as defined above, are set out in the following table:

| Bentonite | Added Electrolyte (wt/wt) | Polyelectrolyte (wt/wt) | % Slurry Solids (wt/wt) |
|---|---|---|---|
| English Brown | 5% NaCl | 0.75% Rheovis CR* | 30% |
| " | 5% $Na_2CO_3$ | 0.75% Rheovis CR* | 30% |
| " | 5% NaCl | 0.75% Rheovis CRX | 30% |

NB Rheovis CR is linear
Rheovis CRX is cross linked

English Brown Bentonite includes 7% $Na_2CO_3$, based on bentonite. Rheovis CR is an alkali-swellable copolymer of a fatty alcohol ethoxylate of allyl ether with methacrylic acid and ethyl acrylate, and Rheovis CRX is a cross linked version of this, all as described in EP-A-216479. Rheovis is a trade mark of Allied Colloids, Ltd., The above formulations provided smooth, fluid suspensions with no tendency to gel on standing, and with no tendency for the suspended bentonite to settle out. On dilution with fresh water, the performance of the bentonite is the same as bentonite suspensions made up in the normal manner and tumbled in fresh water for several hours to promote full hydration.

EXAMPLE 5

A preferred composition for use in a process according to U.S. Pat. No. 4753710 (and other paper making processes, is formed by mixing about 70 parts by weight water with 5 parts by weight sodium chloride and 25 parts by weight of a commercial bentonite which is formed of, approximately, 1 part inorganic electrolyte activator, about 3 parts measurable water and about 21 parts (dry weight) bentonite clay).

We claim:

1. A process for making paper comprising providing a cellulosic suspension at a paper mill, mixing a bentonite swelling clay into the suspension while the clay is in the form of an aqueous dispersion and draining the cellulosic pulp, wherein the bentonite swelling clay is provided at the paper mill as a concentrated aqueous, fluid, dispersion and the clay is mixed into the cellulosic suspension either in the form of this concentrated dispersion and swells in the cellulosic suspension or in the form of a diluted dispersion obtained by diluting the concentrated dispersion and swelling of the bentonite, and wherein the concentrated dispersion comprises at least 15% of the bentonite swelling clay dispersed in substantially unswollen form in an aqueous medium containing dissolved monomeric electrolyte in an amount greater than 10% based on bentonite and which is sufficient to prevent substantial swelling of the bentonite swelling clay.

2. A process according to claim 1 in which the concentrated dispersion is diluted with water to form a diluted aqueous dispersion containing below 10% bentonite swelling clay and in which the clay is in swollen form, and the diluted aqueous suspension is then mixed into the cellulosic system.

3. A process according to claim in which the concentrated dispersion has a viscosity of at least 50 poise at 20° C. measured by a Brookfield Rotational Viscometer, spindle 4, at 20 rpm.

4. A process according to claim 1 in which the concentrated fluid dispersion contains 15 to 30% dry weight bentonite and 2.5 to 10% by weight inorganic electrolyte and the amount of electrolyte based on the bentonite is 10 to 50%.

5. A process according to claim 1 in which the inorganic electrolyte is selected from the group consisting of sodium and ammonium salts that are chlorides, sulphates or carbonates.

6. A process according to claim 1 that comprises the preliminary step of forming the concentrate at the mill by mixing substantially dry bentonite with the electrolyte and the water.

7. A process according to claim 1 in which cationic polymeric retention aid is added to the aqueous suspension, the suspension is subjected to shearing and the bentonite is then added after the shearing.

8. A process according to claim 1 in which the bentonite is added to the suspension and non-ionic, cationic or anionic polymeric retention aid is then added.

* * * * *